US010915057B2

(12) United States Patent
Iwase

(10) Patent No.: US 10,915,057 B2
(45) Date of Patent: Feb. 9, 2021

(54) IMAGE FORMING APPARATUS

(71) Applicant: CANON KABUSHIKI KAISHA, Tokyo (JP)

(72) Inventor: Masaki Iwase, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/909,706

(22) Filed: Jun. 23, 2020

(65) Prior Publication Data

US 2020/0409302 A1 Dec. 31, 2020

(30) Foreign Application Priority Data

Jun. 28, 2019 (JP) ..... 2019-121946

(51) Int. Cl.
*G03G 15/00* (2006.01)
*G03G 21/16* (2006.01)

(52) U.S. Cl.
CPC ..... *G03G 21/1633* (2013.01); *G03G 21/1638* (2013.01)

(58) Field of Classification Search
CPC ..... G03G 21/1633
See application file for complete search history.

(56) References Cited

U.S. PATENT DOCUMENTS 6,540,268 B2 * 4/2003 Pauser ..... A45C 13/06 220/243
2013/0243475 A1 * 9/2013 Lee ..... G03G 21/1633 399/110

FOREIGN PATENT DOCUMENTS

JP 2005-181453 A 7/2005

* cited by examiner

*Primary Examiner* — Clayton E. LaBalle
*Assistant Examiner* — Michael A Harrison
(74) *Attorney, Agent, or Firm* — Canon U.S.A., Inc. I.P. Division

(57) ABSTRACT

An image forming apparatus includes an opening/closing member that pivots with respect to an apparatus main body between a closed position and an open position, a lock mechanism that holds the opening/closing member in the closed position, and a detection member that detects a position of the opening/closing member. The lock mechanism includes a first engaging portion and a second engaging portion at both ends of the apparatus main body, and a first engaged portion and a second engaged portion at both ends of the opening/closing member, in an axial direction. An engagement width for the second engaging portion and the second engaged portion is large compared with that of the first engaging portion and the first engaged portion, when the opening/closing member is in the closed position and locked by the lock mechanism. The detection member is located close to the second engaging portion in the axial direction.

6 Claims, 14 Drawing Sheets

IMAGE FORMING APPARATUS

BACKGROUND

Field of the Disclosure

The present disclosure relates to an image forming apparatus including a lock mechanism for an opening/closing member.

Description of the Related Art

Conventionally, an image forming apparatus such as a copier or a laser beam printer is provided with, in general, an opening/closing member that opens the apparatus main body for jam clearance and replacement of a process cartridge, and the opening/closing member is held in a closed position by a lock mechanism during normal printing. In many cases, such a lock mechanism is provided at two or more positions near both ends of a pivot-type opening/closing member, in order to ensure locking. However, for example, in a case where locks are provided at two position at the right and left ends of the opening/closing member, one-side tightening (one-side latching) in which only one of the locks engages while the other does not engage can occur. This tends to occur, in particular, in a case where it is difficult to ensure sufficient torsional rigidity of an opening/closing member, in a product with an opening/closing member having a wide width such as an A3 machine, or a product with an opening/closing member having a minimum thickness for downsizing.

To address such an issue, there is discussed a configuration including an opening/closing member having a connection shaft connecting a first hook at one end and a second hook at the other end, and an apparatus main body with a hook detection member that detects the position of the first hook (Japanese Patent Application Laid-Open No. 2005-181453). In this configuration, the first hook and the second hook can be engaged with a pair of lock pins disposed in the apparatus main body, and the opening/closing member is locked with respect to the apparatus main body when the first hook and the second hook are engaged with the respective lock pins in the respective lock positions. In this configuration, a hook detection member can detect the first hook not being in the lock position in which the first hook is engaged with the lock pin. In a case where the second hook is not in the lock position in which the second hook is engaged with the lock pin, the first hook is not in the lock position either due to the connection axis. Therefore, the hook detection member can indirectly detect the second hook not being in the lock position.

However, in a case where the opening/closing member being closed is detected based on the position of the hook, it may be desirable that the detection member be disposed in proximity to the hook located near an end portion of the apparatus. Therefore, there may be such an issue that flexibility of the layout of the detection member is limited.

SUMMARY

According to an aspect of the present disclosure, an image forming apparatus includes an apparatus main body configured to form an image, an opening/closing member configured to pivot on an axis with respect to the apparatus main body between a closed position to close an opening of the apparatus main body and an open position to open the opening, a lock mechanism configured to hold the opening/closing member in the closed position, and a detection member configured to detect a position of the opening/closing member. The lock mechanism includes a first engaging portion at one end of the apparatus main body in an axial direction of the axis, a second engaging portion at another end of the apparatus main body in the axial direction of the axis, a connection portion connecting the first engaging portion and the second engaging portion, a first engaged portion at one end of the opening/closing member in the axial direction of the axis, and a second engaged portion at another end of the opening/closing member in the axial direction of the axis. An engagement width for the first engaging portion and the first engaged portion is less than, an engagement width for the second engaging portion and the second engaged portion, in a state where the opening/closing member is in the closed position and locked by the lock mechanism, and the detection member is located closer to the second engaging portion, than the first engaging portion, in the axial direction of the axis.

Further features of the present disclosure will become apparent from the following description of exemplary embodiments with reference to the attached drawings.

DESCRIPTION OF THE EMBODIMENTS

An image forming apparatus according to a first exemplary embodiment in the present disclosure will be described below.

(Image Forming Apparatus)

Figure 1:
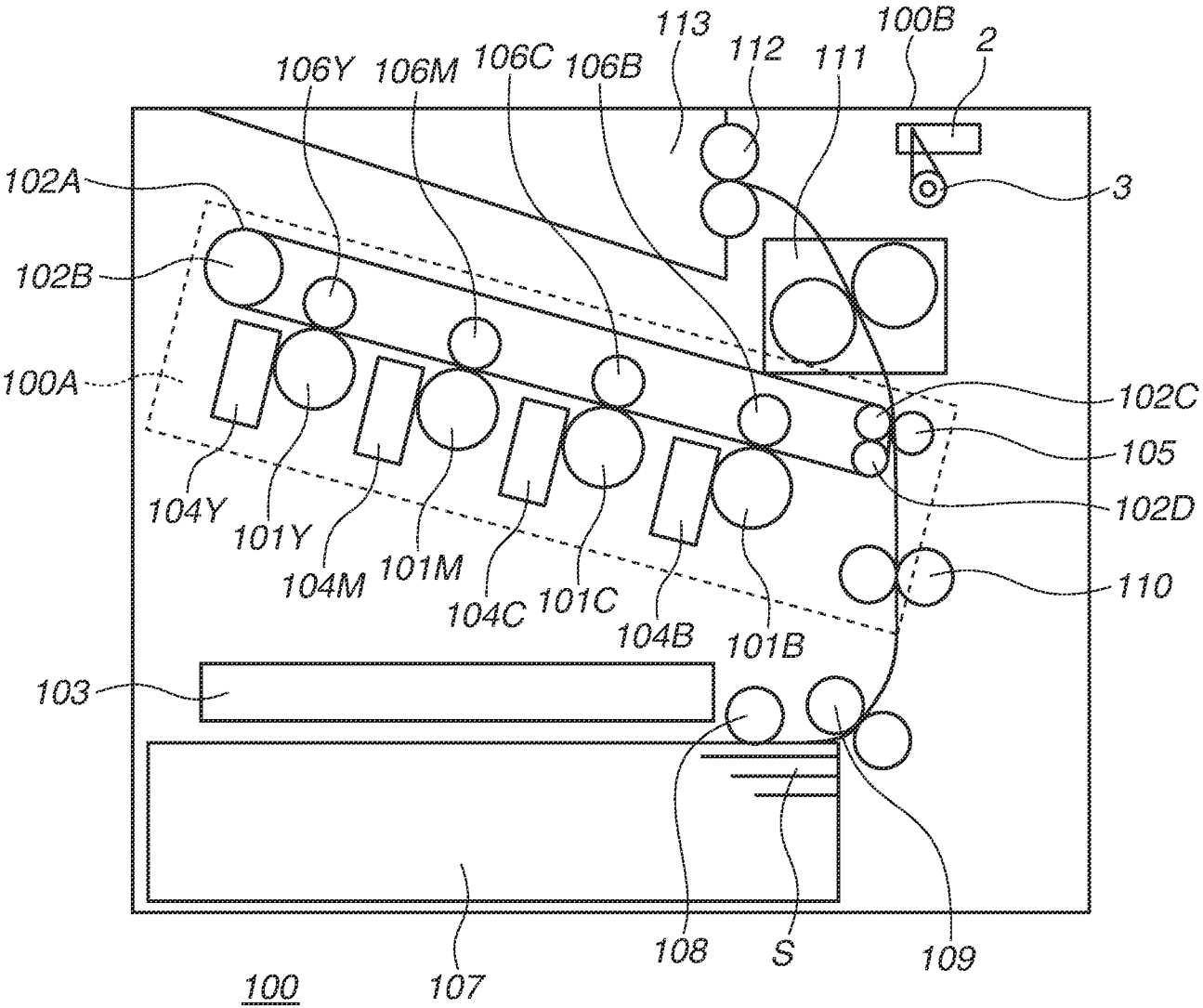
FIG. 1 is a cross-sectional diagram illustrating an image forming apparatus according to a first exemplary embodiment.

FIG. 1 is a schematic diagram illustrating a color laser printer that is an example of the image forming apparatus. An image forming apparatus 100 includes an image forming unit 100A and a fixing unit 111 disposed inside the main body of the image forming apparatus 100. The image forming unit 100A forms an image on a recording material (a sheet) S using an electrophotographic system, and the fixing unit 111 fixes the formed image to the recording material S.

The image forming unit 100A includes stations that form toner images of four colors of yellow, magenta, cyan, and black. The image forming unit 100A further includes an intermediate transfer belt 102A to which the toner images formed in the respective stations are sequentially transferred. Each of the stations includes a photosensitive drum 101 (101Y, 101M, 101C, 101B), and a development unit 104 (104Y, 104M, 104C, 104B) that includes a development roller for developing an electrostatic latent image formed on the photosensitive drum 101. The stations have similar configurations, and configurations for forming the toner images of the respective colors of yellow, magenta, cyan, and black are provided with Y, M, C, and B representing yellow, magenta, cyan, and black, and the description of the configuration for each color will be omitted.

The intermediate transfer belt 102A is an endless belt, and is stretched by a tension roller 102B, a drive roller 102C for rotating the intermediate transfer belt 102A, and a turn roller 102D. The intermediate transfer belt 102A is in contact with the photosensitive drum 101 in each of the stations with pressure from a primary transfer roller 106 (106Y, 106M, 106C, 106B), so that a primary transfer nip is formed. Further, the intermediate transfer belt 102A is in contact with a secondary transfer roller 105 with pressure from the drive roller 102C, so that a secondary transfer nip is formed.

When image forming operation begins in the image forming unit 100A, a laser scanner 103 irradiates each of the photosensitive drums 101 with light corresponding to an image signal, so that an electrostatic latent image is formed on each of the photosensitive drums 101. Subsequently, each of the development units 104 develops the electrostatic latent image using a color (yellow, magenta, cyan, or black) toner contained therein, so that a toner image (a visible image) is formed on the surface of the corresponding photosensitive drum 101. The toner image formed on the surface of each of the photosensitive drums 101 is sequentially subjected to the primary transfer to the surface of the intermediate transfer belt 102A, so that a toner image with the four color toners is formed, and this toner image is conveyed to the secondary transfer nip by the intermediate transfer belt 102A.

In parallel with such toner image forming operation, the sheets S are fed from a sheet containing unit 107 one by one by a pickup roller 108. The fed sheet S is conveyed to the secondary transfer nip formed by the intermediate transfer belt 102A and the secondary transfer roller 105, by a feed roller 109 and a registration roller 110 that corrects skew of the sheet S. Here, to align the position of the sheet S in a sheet conveyance direction with the position of the toner image formed on the intermediate transfer belt 102A, timing for the sheet S is adjusted by controlling the conveyance speed of the registration roller 110 and the feed roller 109. Subsequently, the toner image is transferred from the intermediate transfer belt 102A to the sheet S by application of a bias to the secondary transfer roller 105 at the secondary transfer nip. The sheet S to which the toner image is transferred is conveyed to the fixing unit 111, and the fixing unit 111 fixes the toner image to the sheet S by applying heat and pressure. After the toner image is fixed, a discharge roller 112 discharges the sheet S to a discharge portion 113 located in an upper part of an apparatus main body 100B.

(Opening/Closing Member)

Figure 2B:
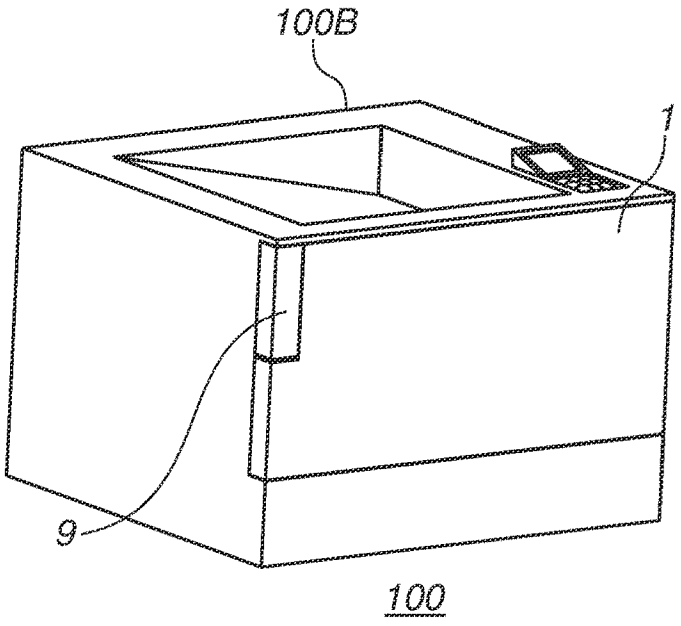
FIGS. 2A and 2B are perspective diagrams each illustrating an appearance of the image forming apparatus according to the first exemplary embodiment.
Figure 2A:
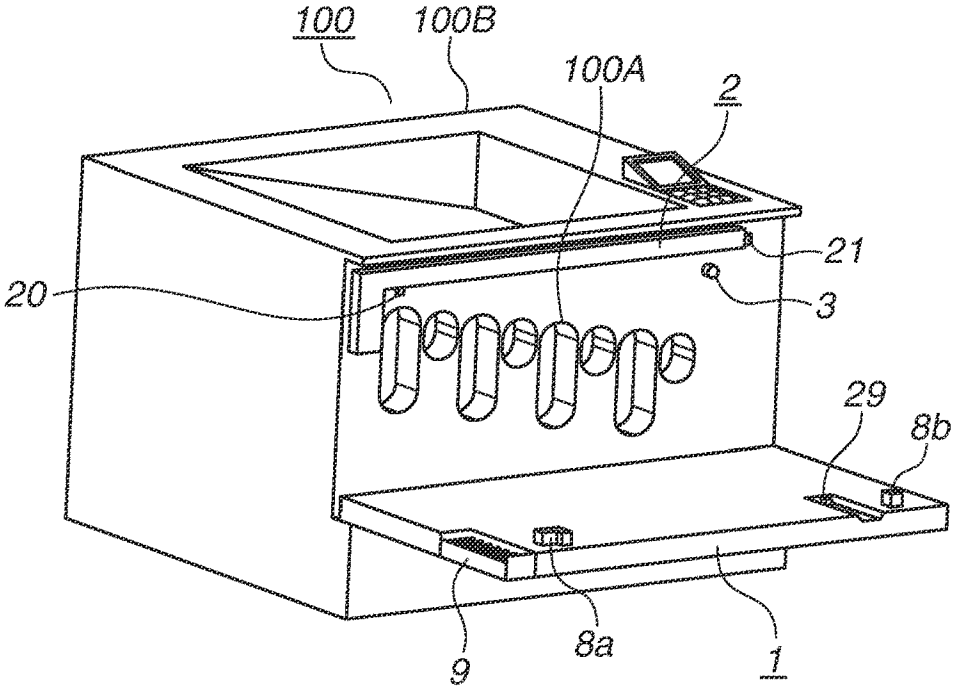

FIGS. 2A and 2B are perspective diagrams illustrating the apparatus main body 100B. FIG. 2A illustrates the apparatus main body 100B in a state where an opening/closing member 1 is closed. FIG. 2B illustrates the apparatus main body 100B in a state where the opening/closing member 1 is open.

The opening/closing member 1 is disposed at a front surface of the apparatus main body 100B that includes the image forming unit 100A and can form an image. The opening/closing member 1 can pivot on a pivot axis extending in a horizontal direction at a vertically lower portion. In a case where the opening/closing member 1 changes from a closed state where the opening/closing member 1 is closed to an open state where the inside of the apparatus main body 100B is exposed, the vertically upper side of the opening/closing member 1 moves away from the apparatus main body 100B. In a case where the opening/closing member 1 is in the open state, the opening/closing member 1 extends in the horizontal direction, so that the photosensitive drum 101 and the development unit 104 can be replaced through an exposed opening portion. In a case where the opening/closing member 1 is in the closed state, the opening/closing member 1 is locked with respect to the apparatus main body 100B by a lock mechanism 2.

Figure 3A:
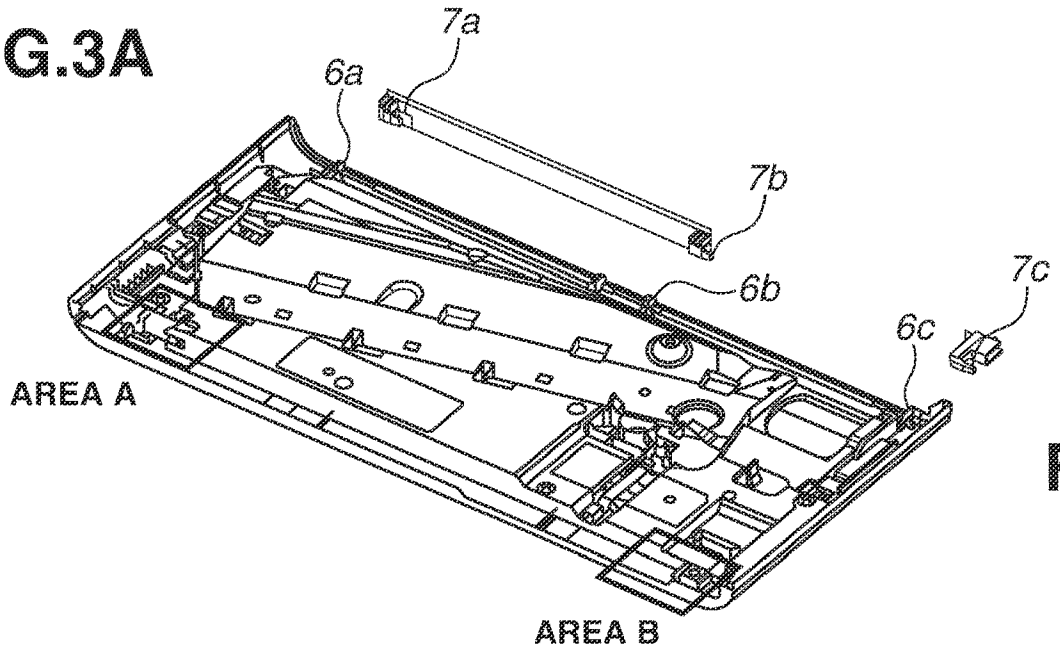
FIGS. 3A, 3B, and 3C are perspective diagrams illustrating a configuration of an opening/closing member of the image forming apparatus according to the first exemplary embodiment.
Figure 3B:
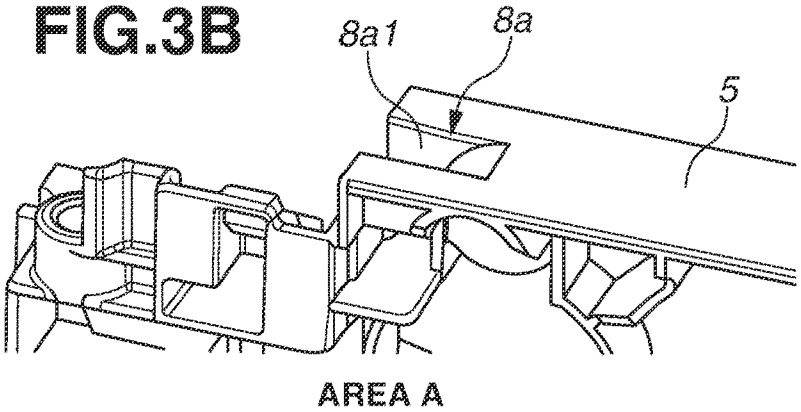
Figure 3C:
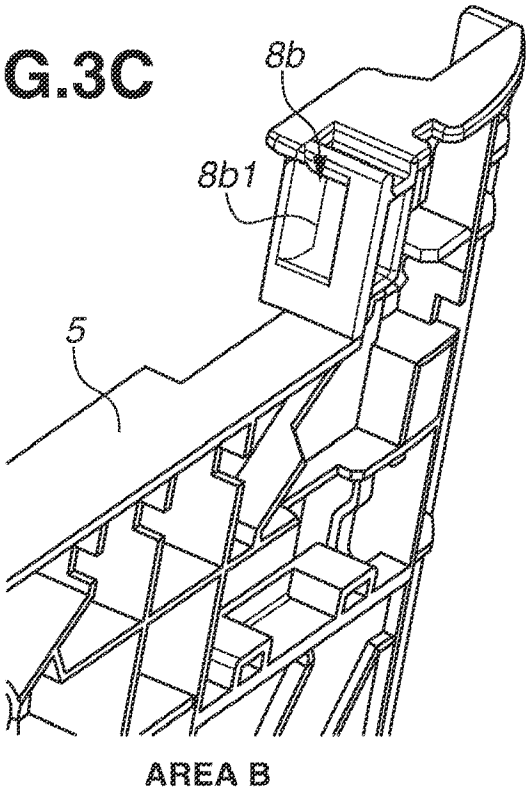

A configuration of the opening/closing member 1 will be described in detail with reference to FIGS. 3A to 3C. FIG. 3A is a perspective diagram illustrating an overall configuration of the opening/closing member 1. FIG. 3B illustrates an enlarged view of an area A in FIG. 3A and a detailed configuration of a frame 5 of the opening/closing member 1. FIG. 3C illustrates an enlarged view of an area B in FIG. 3A and a detailed configuration of the frame 5 of the opening/closing member 1.

The opening/closing member 1 is configured as a door by fastening an outer casing 4 (FIG. 4A) and the frame 5 using a plurality of screws. Rotation hinge holes 6*a*, 6*b*, and 6*c* support the opening/closing member 1 to be pivotable with respect to the apparatus main body 100B, when hinges 7*a*, 7*b*, and 7*c* of the apparatus main body 100B are fitted in the rotation hinge holes 6*a*, 6*b*, and 6*c*. In other words, the opening/closing member 1 can pivot using the hinges 7*a*, 7*b*, and 7*c* of the apparatus main body 100B as the pivot axis extending in the horizontal direction. Further, a handle 9 (FIGS. 4A and 4B) is fixed to the frame 5 of the opening/closing member 1.

Figure 4A:
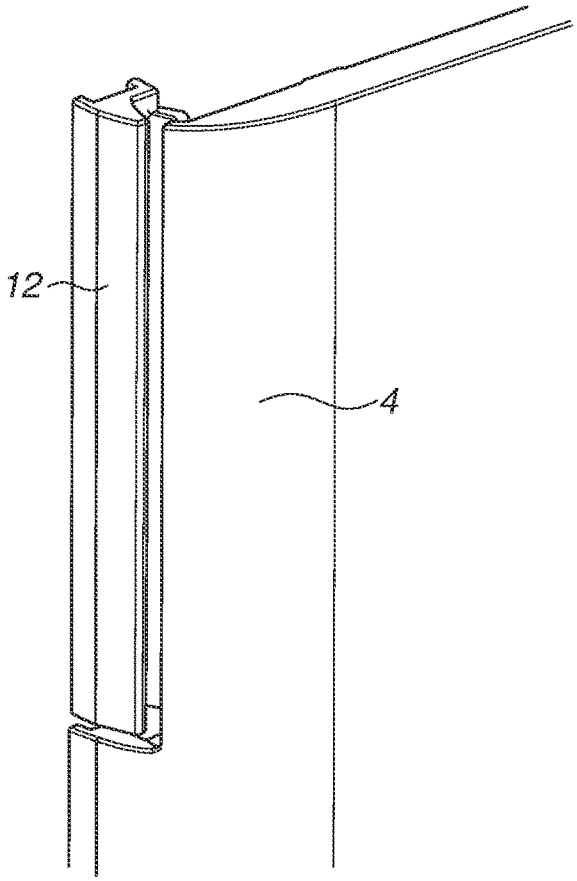
FIGS. 4A and 4B are perspective diagrams illustrating a handle of the opening/closing member of the image forming apparatus according to the first exemplary embodiment.
Figure 4B:
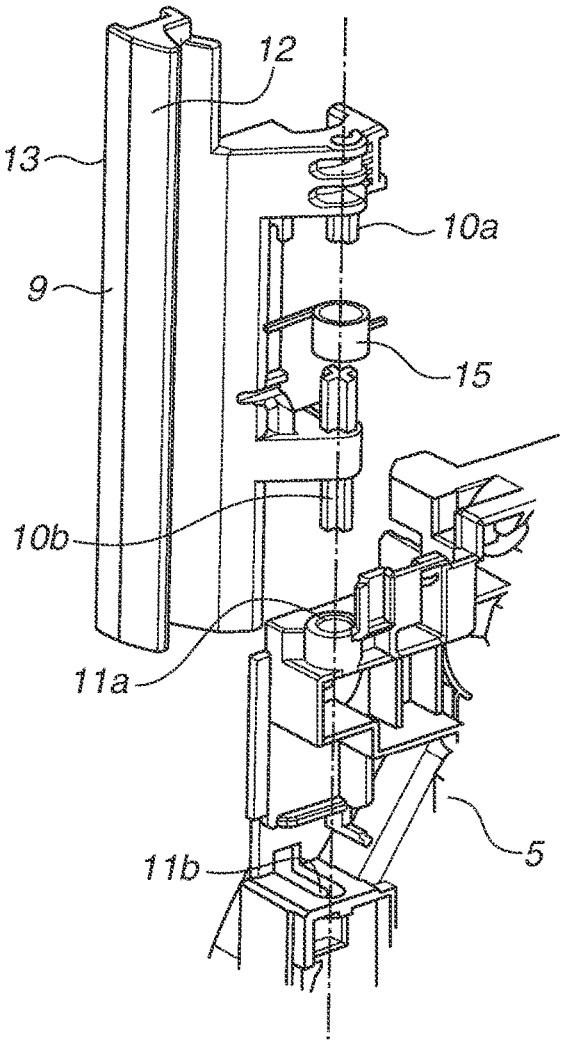

FIGS. 4A and 4B are perspective diagrams illustrating the handle 9 of the opening/closing member 1. FIG. 4A illustrates the handle 9 as viewed from an external surface of the image forming apparatus 100, and FIG. 4B illustrates the handle 9 and a configuration around the handle 9 (the outer casing 4 not illustrated). The handle 9 is a member including handle shafts 10*a* and 10*b*. The handle shafts 10*a* and 10*b* are inserted into handle holding portions 11*a* and 11*b* of the frame 5, so that the handle 9 is pivotably held. The handle 9 is urged by a handle urging spring 15 toward the frame 5, so that the home position of the handle 9 is a position in which an outer casing surface 12 of the handle 9 and an external surface of the outer casing 4 are flush with each other as illustrated in FIG. 4A. A user pulls a grip portion 13 while holding the grip portion 13, so that the handle 9 pivots on the handle shafts 10*a* and 10*b*. When the user releases the handle 9 upon stopping the pulling operation, the handle 9 returns to the home position due to the urging force of the handle urging spring 15.

Further, as illustrated in FIGS. 3B and 3C, the frame 5 of the opening/closing member 1 includes latch locking portions 8*a* and 8*b* (a first engaged portion and a second engaged portion) each in a depression shape, as part of the lock mechanism 2. The opening/closing member 1 is locked to the apparatus main body 100B by engaging the latch locking portions 8*a* and 8*b* with the apparatus main body 100B.

Figure 5B:
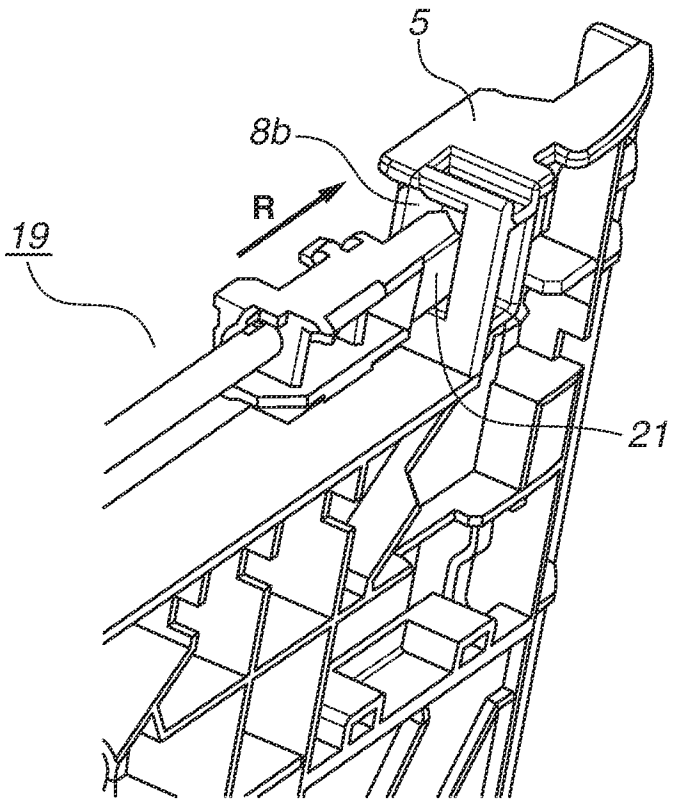
FIGS. 5A and 5B are perspective diagrams illustrating a lock mechanism of the image forming apparatus according to the first exemplary embodiment.
Figure 5A:
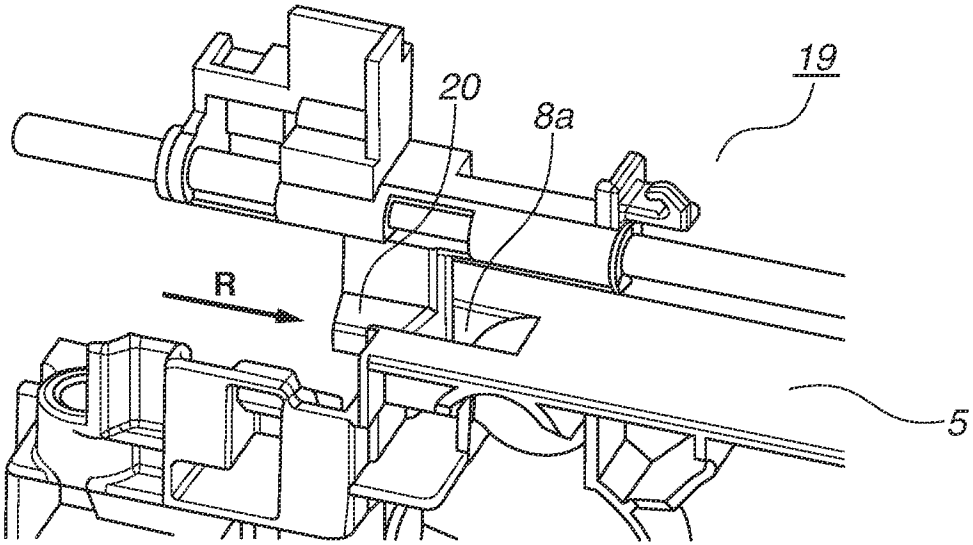

Next, the lock mechanism 2 for locking the opening/closing member 1 with respect to the apparatus main body 100B will be described with reference to FIGS. 5A and 5B. FIG. 5A illustrates a configuration in which the latch locking portion 8*a* at one end of the opening/closing member 1 is locked by the apparatus main body 100B. FIG. 5B illustrates a configuration in which the latch locking portion 8*b* at the other end of the opening/closing member 1 is locked by the apparatus main body 100B. When the opening/closing member 1 is in the closed position, at least a part of a latch 20 (a first engaging portion) of a latch unit 19 disposed in the apparatus main body 100B is located in the latch locking portion 8*a* (the first engaged portion), and at least a part of a latch 21 (a second engaging portion) of the latch unit 19 is located in the latch locking portion 8*b* (the second engaged portion). A lock state for regulating the movement of the opening/closing member 1 is thereby established, i.e., in the lock state, the latch locking portion 8*a* interferes with the latch 20 and the latch locking portion 8*b* interferes with the latch 21, even if an attempt to pivot the opening/closing member 1 with respect to the apparatus main body 100B is made. After the opening/closing member 1 is changed to the closed state, the latch 20 and the latch 21 each shift to a lock position by sliding in an R-direction in FIGS. 5A and 5B and then entering the latch locking portion 8*a* and the latch locking portion 8*b*, respectively, so that the latch 20 and the latch 21 regulate the movement of the opening/closing member 1.

Figure 6C:
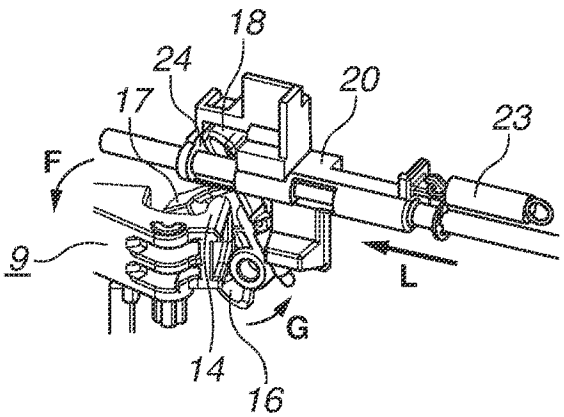
FIGS. 6A, 6B and 6C are perspective diagrams illustrating the lock mechanism of the image forming apparatus according to the first exemplary embodiment.
Figure 6B:
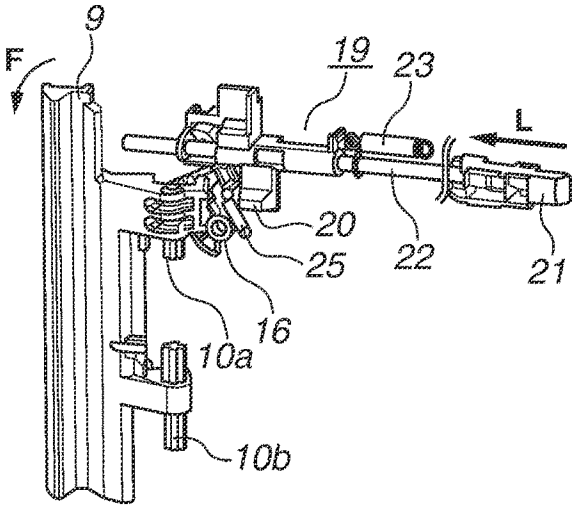
Figure 6A:
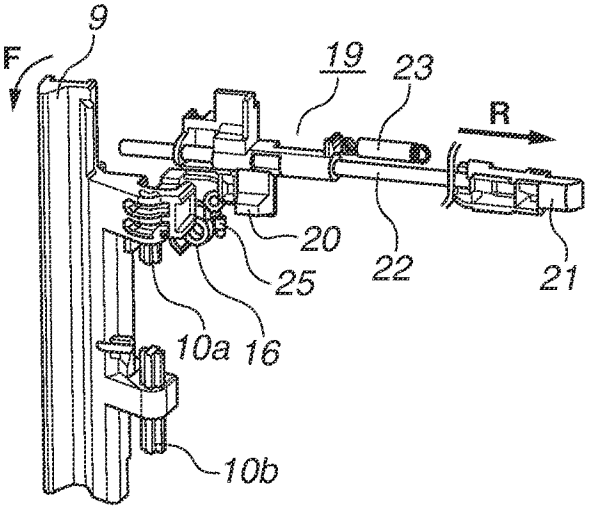

Next, operation of interlock between the handle 9 of the opening/closing member 1 and the latch unit 19 of the apparatus main body 100B when the opening/closing member 1 is in the closed state with respect to the apparatus main body 100B will be described with reference to FIGS. 6A to 6C. FIGS. 6A to 6C are perspective diagrams illustrating a configuration of the lock mechanism 2 including the handle 9 of the opening/closing member 1 and the latch unit 19 of the apparatus main body 100B. FIG. 6A illustrates a state where the opening/closing member 1 is in a locked position, and FIG. 6B illustrates a state where the opening/closing member 1 is in an unlocked position. FIG. 6C is an enlarged diagram illustrating a configuration including a latch release lever 16 and a portion therearound.

The latch unit 19 includes a latch shaft (a connection shaft) 22, the latch 20 assembled to one end of the latch shaft 22, the latch 21 assembled to the other end of the latch shaft 22, and a latch spring 23. In the latch unit 19, the latch shaft 22 that can move is urged by an urging force of the latch spring 23 in an arrow-R direction in FIG. 6A for locking the opening/closing member 1. The latch release lever 16 is a member disposed in the apparatus main body 100B, and is a connection member that transmits the operation of the handle 9 to the latch unit 19. When the handle 9 is operated by the user to pivot in an F-direction illustrated in FIGS. 6A to 6C, a lever abutment portion 14 of the handle 9 presses a handle abutment portion 17 of the latch release lever 16 as illustrated in FIG. 6C, so that the latch release lever 16 pivots counterclockwise in FIG. 6C. When the latch release lever 16 pivots in a G-direction (counterclockwise) opposite to the F-direction, a latch abutment portion 18 presses a lever abutment surface 24 of the latch 20, so that the latch unit 19 moves in an arrow-L direction in FIG. 6C. The latch 20 and the latch 21 thereby retract to the respective positions for not interfering with the latch locking portion 8*a* and the latch locking portion 8*b* during opening/closing (pivoting) of the opening/closing member 1, so that the opening/closing member 1 can be opened/closed. Subsequently, because the handle 9 is pulled by the user toward the open position, the opening/closing member 1 is opened to the open position. When the opening/closing member 1 is opened, the latch shaft 22 and the latches 20 and 21 of the latch unit 19 each move to a lockable position due to the urging force of the latch spring 23, and a latch release lever returning spring 25 returns the latch release lever 16 to the initial position.

Here, the apparatus main body 100B is provided with a detection member 3 in order to detect an open/closed state of the opening/closing member 1 that can be opened and closed with respect to the apparatus main body 100B. The detection member 3 detects the position of the opening/closing member 1 to prevent execution of image formation when the opening/closing member 1 is in the open position, i.e., when the opening/closing member 1 is not in the closed position. In the present exemplary embodiment, a push switch for detecting opening/closing of the opening/closing member 1 is disposed on the front surface of the apparatus main body 100B, and this push switch is used as the detection member 3. The detection member 3 detects the opening/closing member 1 being in the closed position, when the detection member 3 is pressed by a protrusion 29 (an acting portion) by a predetermined amount X1 serving as a threshold from a detection position. The protrusion 29 (the acting portion) is a part of the frame 5 of the opening/closing member 1 to act on the detection member 3.

Figures 7A, 7B, 7C, 7D:
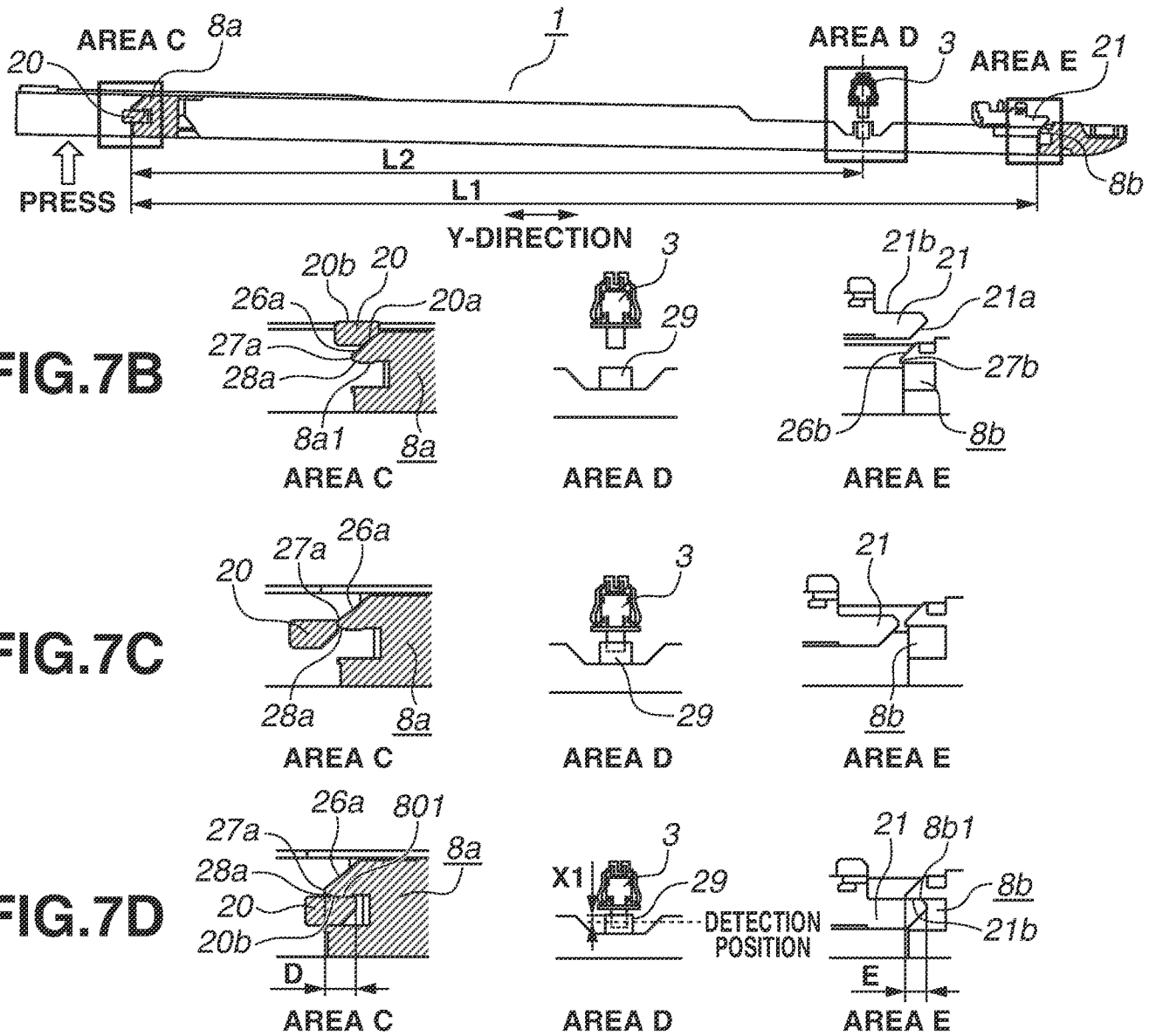
FIGS. 7A, 7B, 7C and 7D are detailed diagrams illustrating operation of the lock mechanism of the image forming apparatus according to the first exemplary embodiment.

FIGS. 7A to 7D are detailed diagrams illustrating a relationship between the latch 20 of the latch unit 19 and the latch locking portion 8*a* of the opening/closing member 1, a relationship between the latch 21 of the latch unit 19 and the latch locking portion 8*b* of the opening/closing member 1, and a relationship between the detection member 3 and the protrusion 29 of the opening/closing member 1. FIGS. 7A to 7D illustrate movements when a central portion of the opening/closing member 1 is urged to close the opening/closing member 1. FIG. 7A is a schematic top view illustrating areas C to E in the opening/closing member 1.

FIG. 7B is an enlarged diagram illustrating the areas C to E in FIG. 7A, and illustrates a state where closing of the opening/closing member 1 begins, and a slope 20*a* of the latch 20 abuts a first slope 26*a* of the latch locking portion 8*a*. FIG. 7C is an enlarged diagram illustrating the areas C to E in FIG. 7A, and illustrates a state where the latch 20 moves along the first slope 26*a* as closing of the opening/closing member 1 proceeds, and the latch 20 reaches a top 27*a* of the latch locking portion 8*a*. At this moment, the detection member 3 is in a state of being in contact with the protrusion 29 of the opening/closing member 1 and pressed by a certain amount, but this amount is less than the predetermined press amount (the threshold), and thus the detection member 3 detects the opening/closing member 1 being in the open state. FIG. 7D is an enlarged diagram illustrating the areas C to E in FIG. 7A, and illustrates a state where the opening/closing member 1 is in the closed state following the state in FIG. 7B, and the latch 20 is in the lock position upon moving along a second slope 28*a*. At this moment, the detection member 3 is in a state of being in contact with the protrusion 29 of the opening/closing member 1 and further pressed, i.e., in a state of being pressed further than the detection position by the predetermined press amount (X1) or more, so that the detection member 3 detects the opening/closing member 1 being in the closed state. The closed state is thus detected, so that the image forming operation is executed in a case where a command for forming an image is issued to the image forming apparatus 100.

Figure 8A:
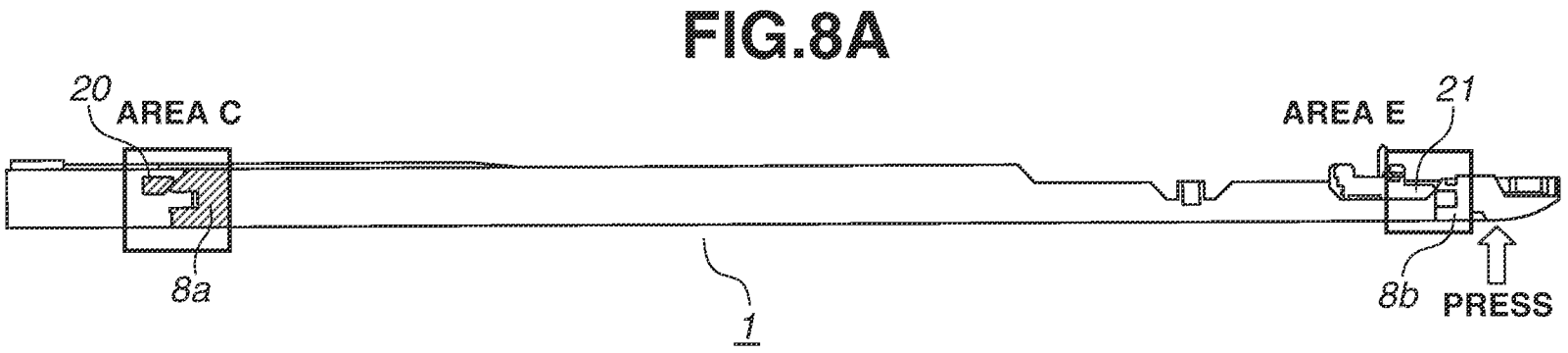
FIGS. 8A, 8B and 8C are cross-sectional diagrams illustrating operation for preventing one-side tightening of the opening/closing member of the image forming apparatus according to the first exemplary embodiment.

In the present exemplary embodiment, there is adopted such a configuration (FIGS. 7A to 7D) that a first engagement width D at which an engaging surface 20*b* of the latch 20 comes into contact with an engaged surface 8*al* of the latch locking portion 8*a* is smaller than a second engagement width E at which an engaging surface 21*b* of the latch 21 comes into contact with an engaged surface 8*b*1 of the latch locking portion 8*b*. In other words, the first engagement width D for the latch 20 and the latch locking portion 8*a* is larger than the second engagement width E for the latch 21 and the latch locking portion 8*b*, so that only the latch 20 side of the latch unit 19 abuts the opening/closing member 1 during the closing operation of the opening/closing member 1. In other words, the latch 21 and the latch locking portion 8*b* are configured not to be in contact with each other such that a state where the latch 21 is engaged with the latch locking portion 8*b* is established Here, a case where the opening/closing member 1 is closed by pressing a portion near the latch locking portion 8*b* in the opening/closing member 1 to bring the latch 21 into contact with the latch locking portion 8*b* will be described with reference to FIGS. 8A to 8C. FIG. 8A is a schematic top view illustrating the area C and the area E in the opening/closing member 1. FIG. 8B is an enlarged diagram illustrating the area C in FIG. 8A, and is a top view of a portion near the opening/closing member 1 as viewed vertically from above, illustrating a state where the portion near the latch locking portion 8*b* in the opening/closing member 1 is pressed in closing the opening/closing member 1. Pressing the portion near the latch locking portion 8*b* tilts the opening/closing member 1 so that the latch locking portion 8*b* abuts the latch unit 19 prior to the latch locking portion 8*a*.

Figure 8C:
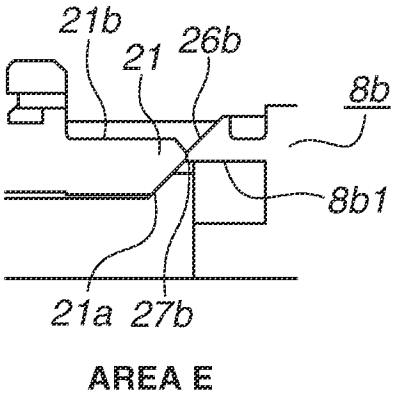
Figure 8B:
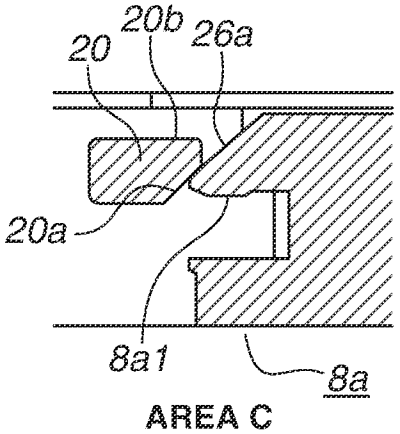

Pressing the portion near the latch locking portion 8*b* further therefrom causes a slope 21*a* of the latch 21 to abut a first slope 26*b* of the latch locking portion 8*b* and move to a top 27*b* of the latch locking portion 8*b* along the first slope 26*b*, as illustrated in FIG. 8C illustrating the area E in FIG. 8A. Meanwhile, the latch 20 slides in the axial direction of the latch shaft 22 by an amount corresponding to the amount of the movement of the latch 21 (FIG. 8B), because the latch 20 is connected to the latch 21 by the latch shaft 22 and configured to move in an interlocking manner. However, the latch 20 can only move up to a midpoint of the first slope 26*a*, so that the latch 20 cannot move to a position for enabling engagement with the latch locking portion 8*a*. In other words, the latch 20 cannot be moved to the position for enabling the engagement with the latch locking portion 8*a*, even in a case where the opening/closing member 1 is moved, the latch 21 advances beyond the top 27*b*, and the latch 21 is moved to a position for enabling engagement with the latch locking portion 8*b*. In such a state where the latch locking portion 8*a* cannot be engaged with the latch 20, the latch 21 cannot be engaged with the latch locking portion 8*b*, and thus the opening/closing member 1 is prevented from being locked by the lock mechanism 2 in the state of the one-side tightening (one-side latching). In the present exemplary embodiment, the configuration (FIGS. 7A to 7D) in which the second engagement width E of the latch 21 is smaller than the first engagement width D of the latch 20 is adopted. With this simple configuration, in a case where the opening/closing member 1 is closed by pressing the portion near the latch locking portion 8*b*, the latch locking portion 8*a* does not engage, so that the one-side tightening of the opening/closing member 1 can be prevented.

Figure 9A:
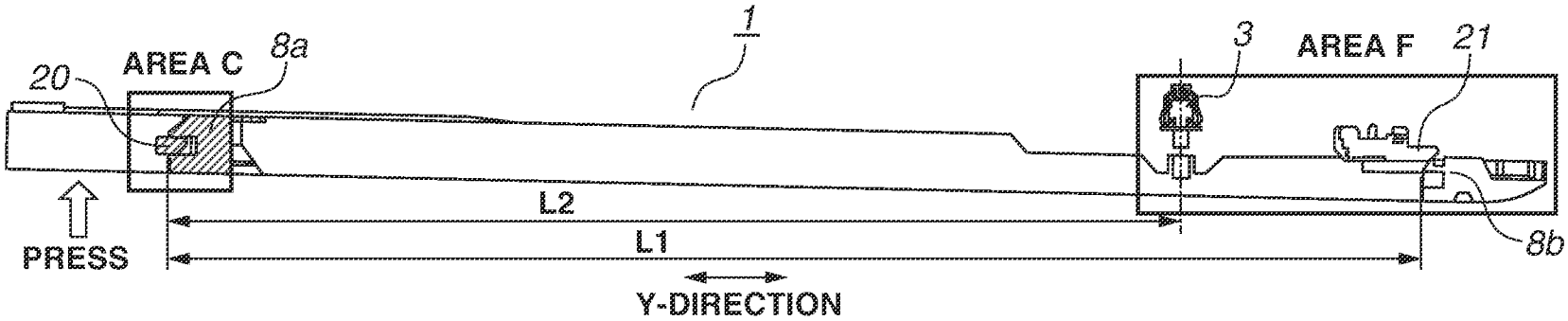
FIGS. 9A, 9B and 9C are cross-sectional diagrams illustrating a method of detecting occurrence of one-side tightening of the opening/closing member of the image forming apparatus according to the first exemplary embodiment.
Figure 9C:
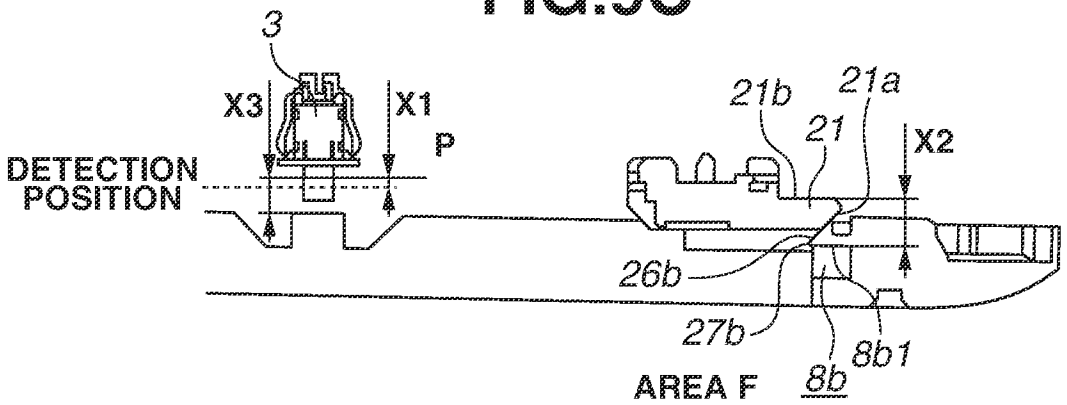
Figure 9B:
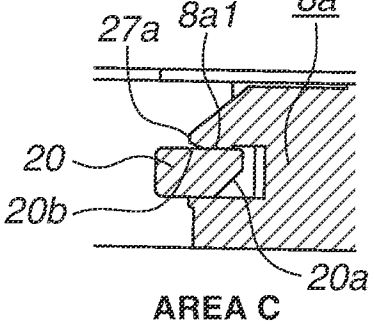

Next, a case where the opening/closing member 1 is closed by pressing a portion near the latch locking portion 8*a* in the opening/closing member 1 to bring the latch 20 into contact with the latch locking portion 8*a* will be described with reference to FIGS. 9A to 9C. FIG. 9A is a schematic top view illustrating the area C and an area F in the opening/closing member 1. FIG. 9B is an enlarged diagram illustrating the area C in FIG. 9A, and is a top view of a portion near the opening/closing member 1 as viewed vertically from above, illustrating a state where the portion near the latch locking portion 8*a* in the opening/closing member 1 is pressed in closing the opening/closing member 1. Pressing the portion near the latch locking portion 8*a* tilts the opening/closing member 1 so that the latch locking portion 8*a* abuts the latch unit 19 prior to the latch locking portion 8*b*.

Pressing the portion near the latch locking portion 8*a* further therefrom causes the latch 20 to advance beyond the top 27*a* as illustrated in FIG. 9B, so that a lock state where a part of the latch 20 is located inside the latch locking portion 8*a* is established. Meanwhile, the latch 21 does not advance beyond the top 27*b* as illustrated in FIG. 9C illustrating the area F in FIG. 9A, and thus there is a case where a lock state where a part of the latch 21 is located inside the latch locking portion 8*b* is not established.

When the state of the one-side tightening thus occurs, the latch locking portion 8*b* of the opening/closing member 1 is pushed out by the latch 21 to a position for opening the opening/closing member 1 in an opening direction of the opening/closing member 1, by a predetermined amount X2. At this moment, the detection member 3 comes in contact with the protrusion 29 of the opening/closing member 1, and is pushed out to a position away, by a distance X3, from a position P in which the detection member 3 is pressed by the predetermined press amount in the closed state. Therefore, in the present exemplary embodiment, the detection member 3 detects the open state in the state of the one-side tightening, so that the image forming apparatus does not execute the image forming operation at the time of the one-side tightening of the opening/closing member 1. Specifically, the distance X3 from a position of the protrusion 29 during the one-side tightening to a position of the protrusion 29 when the opening/closing member 1 is in the closed position is large with respect to the distance X1 from a position of the protrusion 29 for enabling the detection member 3 to detect the closed state to the position of the protrusion 29 when the opening/closing member 1 is in the closed position. Because the distance X3 is large with respect to the distance X1, a condition for an installation position in a product width direction (the axial direction of the pivot axis of the opening/closing member 1) of the detection member 3 is as follows.

$$L2>X1/X2\times L1$$

L2: A distance from the latch 20 to the detection member 3 in the axial direction of the pivot axis of the opening/closing member 1

L1: A distance from the latch 20 to the latch 21 in the axial direction of the pivot axis of the opening/closing member 1

X1: The distance from the position of the protrusion 29 for enabling the detection member 3 to detect the closed state to the position of the protrusion 29 when the opening/closing member 1 is in the closed position X2: The distance between the engaging surface 21*b* of the latch 21 and the engaged surface 8*b*1 of the latch locking portion 8*b* in the pivot direction of the opening/closing member 1

Figure 10:
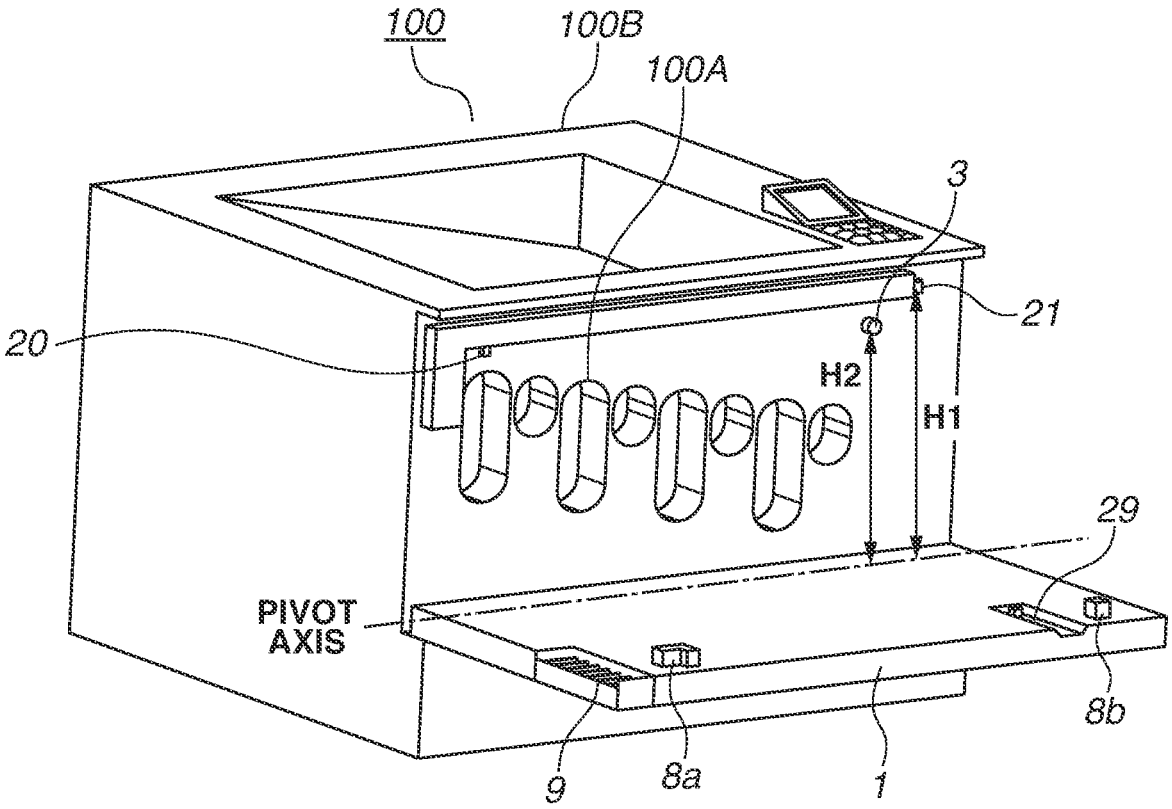
FIG. 10 is a perspective diagram illustrating an installation position of the detection member of the image forming apparatus according to the first exemplary embodiment.

Further, because the distance X3 is large with respect to the distance X1, a condition for an installation position in a product height direction (a direction intersecting the axial direction of the pivot axis of the opening/closing member 1, i.e., a vertical direction) is as follows (FIG. 10).

$$H2>X1/X2\times H1$$

H2: A distance from the pivot axis of the opening/closing member 1 to the protrusion 29 in the direction intersecting the axial direction of the pivot axis of the opening/closing member 1

H: A distance from the pivot axis of the opening/closing member 1 to the latch 21 in the direction intersecting the axial direction of the pivot axis of the opening/closing member 1

X1: The distance from the position of the protrusion 29 for enabling the detection member 3 to detect the closed state to the position of the protrusion 29 when the opening/closing member 1 is in the closed position X2: The distance between the engaging surface 21*b* of the latch 21 and the engaged surface 8*b*1 of the latch locking portion 8*b* in the pivot direction of the opening/closing member 1

The detection member 3 thus disposed can thereby detect the opening/closing member 1 being in the open state, and stop the operation of the apparatus main body 100B, at the time of the one-side tightening in which the latch 21 is not locked. The one-side latching is thus detected using the detection member 3, so that the configuration can be achieved using a small number of members. Moreover, in the configuration of the present exemplary embodiment, the latch being set in the lock position is not directly detected, so that the placement of the detection member is not restricted by the installation position of each of the latch and the latch locking portion, and thus the image forming apparatus can be downsized.

Next, a second exemplary embodiment in the present disclosure will be described. Configurations similar to those of the first exemplary embodiment are assigned the same reference numerals as the first exemplary embodiment and will not be described.

In the first exemplary embodiment, the latches 20 and 21 connected via the latch shaft 22 slide in the axial direction, but this is not limitative. In the present exemplary embodiment, a configuration in which latches 30 and 31 are connected via a latch shaft 32 and each pivot on the latch shaft 32 will be described. Due to this change in configuration, although the latch locking portion 8*a* and the latch locking portion 8*b* in the opening/closing member 1 are each shaped to open toward one end in the axial direction of the pivot axis in the first exemplary embodiment, the latch locking portion 8*a* and the latch locking portion 8*b* in the second exemplary embodiment are each shaped to open in a direction away from the pivot axis (a vertically upward direction).

Figure 11C:
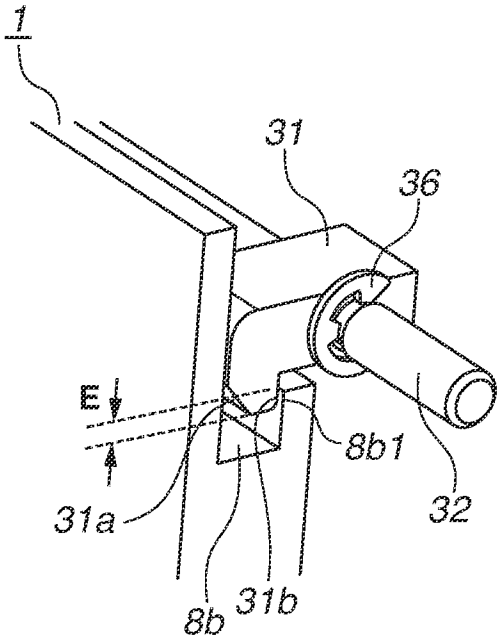
FIGS. 11A, 11B, and 11C are perspective diagrams illustrating a lock mechanism of an image forming apparatus according to a second exemplary embodiment.
Figure 11B:
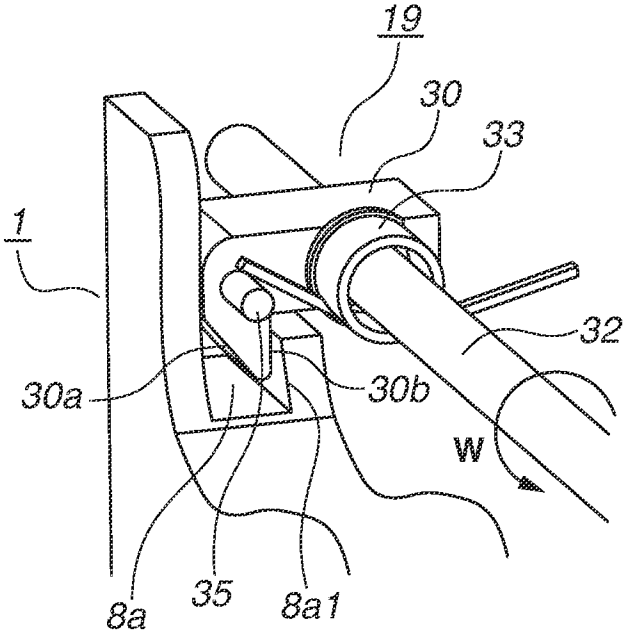
Figure 11A:
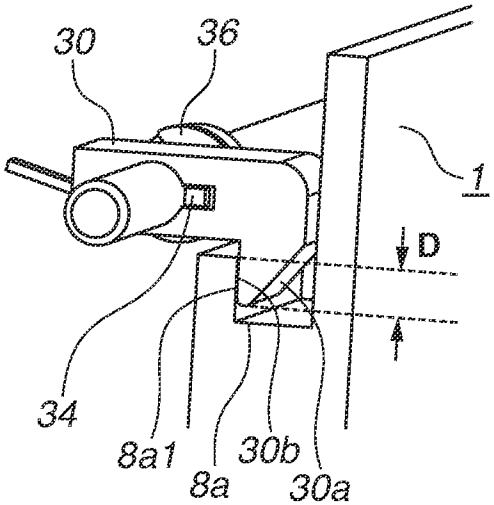

FIGS. 11A to 11C are perspective diagrams illustrating the latch unit 19 of the lock mechanism 2 in the second exemplary embodiment, and a portion near the latch locking portions 8*a* and 8*b* of the opening/closing member 1. As illustrated in FIGS. 11A and 11B, the latch 30 is fixed to the latch shaft 32 by a parallel pin 34 and an E-ring 36 at a position near one end of the latch shaft 32, and rotates around the axis of the latch shaft 32 in a V-direction (FIG. 12C) opposite to a W-direction. The latch 31 is also fixed in a similar way at a position near the other end of the latch shaft 32 as illustrated in FIG. 11C. A latch spring 33 that is a torsion coil spring is held around the latch shaft 32, and one end of the latch spring 33 is configured to abut a spring holding portion 35 of the latch 30. The other end of the latch spring 33 is held on a spring locking portion (not illustrated) of the apparatus main body 100B, so that the latch unit 19 is urged in the W-direction in FIG. 11B. The latches 30 and 31 are locked by the latch locking portions 8*a* and 8*b*, respectively, of the opening/closing member 1, and hold the opening/closing member 1 in a closed position (a closed state).

Figures 12A, 12B, 12C, 12D:
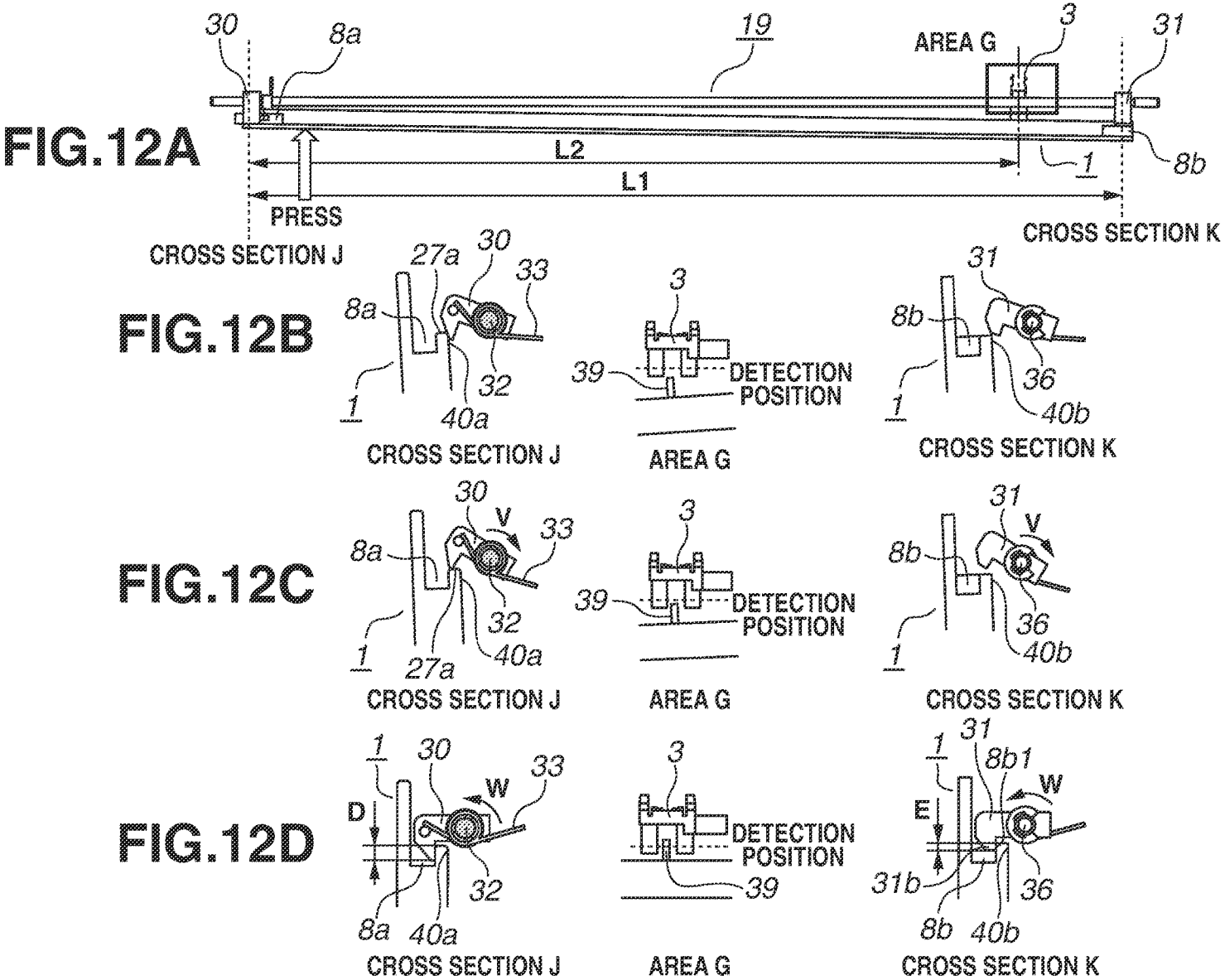
FIGS. 12A, 12B, 12C, and 12D are detailed diagrams illustrating operation of the lock mechanism of the image forming apparatus according to the second exemplary embodiment.

FIGS. 12A to 12D are detailed diagrams illustrating a relationship between the latch 30 of the latch unit 19 and the latch locking portion 8*a* of the opening/closing member 1, a relationship between the latch 31 of the latch unit 19 and the latch locking portion 8*b* of the opening/closing member 1, and a relationship between the detection member 3 and a protrusion 39 of the opening/closing member 1. FIGS. 12A to 12D illustrate movements when a central portion of the opening/closing member 1 is urged to close the opening/closing member 1. FIG. 12A is a schematic top view illustrating an area G, and the position of each of cross sections J and K in the opening/closing member 1.

FIG. 12B is a cross-sectional diagram illustrating the cross section J in FIG. 12A, and illustrates a state where closing of the opening/closing member 1 begins, and a slope 30*a* (FIGS. 11A and 11B) of the latch 30 abuts a latch abutment portion 40*a* of the latch locking portion 8*a*. FIG. 12C is an enlarged diagram illustrating the area G in FIG. 12A, and illustrates a state where the latch 30 rotates as closing of the opening/closing member 1 proceeds, and the latch 30 reaches a top 27*a* of the latch locking portion 8*a*. At this moment, the detection member 3 is in a state of being in contact with the protrusion 39 of the opening/closing member 1 and pressed by a certain amount, but this amount is less than a predetermined press amount, and thus the detection member 3 detects the opening/closing member 1 being in the open state. FIG. 12D is a cross-sectional diagram illustrating the cross section K in FIG. 12A, and illustrates a state where the opening/closing member 1 is in the closed state following the state in FIG. 12B, and the latch 30 is in a lock position. At this moment, the protrusion 39 of the opening/closing member 1 is in a state of entering the detection member 3 by the predetermined amount or more, and detects the closed state. The closed state is thus detected, so that image forming operation is executed in a case where a command for forming an image is issued to an image forming apparatus 100.

Figure 13A:
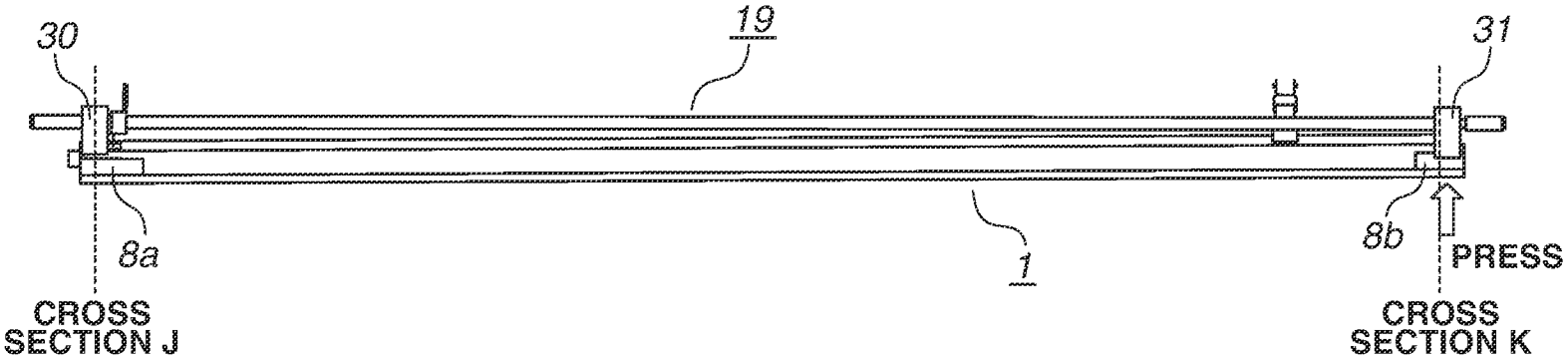
FIGS. 13A, 13B, and 13C are cross-sectional diagrams illustrating operation for preventing one-side tightening of an opening/closing member of the image forming apparatus according to the second exemplary embodiment.
Figure 13B:
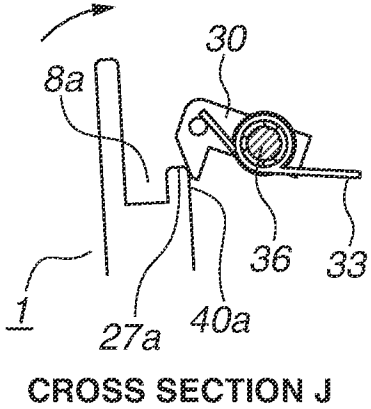
Figure 13C:
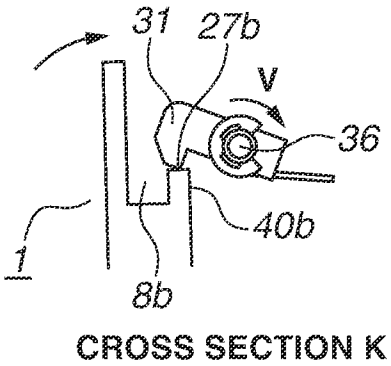

Next, a case where the opening/closing member 1 is closed by pressing a portion near the latch locking portion 8*a* in the opening/closing member 1 to bring the latch 31 into contact with the latch locking portion 8*a* will be described with reference to FIGS. 13A to 13C. FIGS. 13A to 13C are detailed diagrams illustrating a relationship between the latch 30 of the latch unit 19 and the latch locking portion 8*a* of the opening/closing member 1, a relationship between the latch 31 of the latch unit 19 and the latch locking portion 8*b* of the opening/closing member 1, and a relationship between the detection member 3 and the protrusion 39 of the opening/closing member 1.

FIG. 13A is atop view of a portion near the opening/closing member 1 as viewed vertically from above, illustrating a state where the portion near the latch locking portion 8*b* in the opening/closing member 1 is pressed in closing the opening/closing member 1. FIG. 13B is a cross-sectional diagram illustrating the cross section J in FIG. 13A, and FIG. 13C is a cross-sectional diagram illustrating the cross section K in FIG. 13A.

Pressing the portion near the latch locking portion 8*b* brings the opening/closing member 1 into a state where the latch locking portion 8*b* abuts the latch unit 19 prior to the latch locking portion 8*a*, so that the opening/closing member 1 tilts. Pressing the portion near the latch locking portion 8*b* further therefrom causes the latch 31 to abut the latch locking portion 8*b*, the latch 31 rotates in the V-direction opposite to the W-direction at a latch abutment portion 40*b*, and the latch locking portion 8*b* moves to the top 27*b* (FIG. 13C). Meanwhile, because the latch 30 is connected to the latch 31 by the latch shaft 32 and configured to rotate in an interlocking manner, the latch shaft 32 rotates by an amount corresponding to the amount of the rotation of the latch 31. However, the latch 30 cannot move to the top 27*a* while remaining in contact with the latch abutment portion 40*a*, so that the latch 30 cannot move to a position for enabling engagement with the latch locking portion 8*a* (FIG. 13B). In other words, the latch 30 cannot be moved to the position for enabling the engagement with the latch locking portion 8*a*, even in a case where the opening/closing member 1 is moved to cause the latch 31 to advance beyond the top 27*b* and the latch 31 is moved to a position for enabling engagement with the latch locking portion 8*b*. In such a state where the latch locking portion 8*a* is not engaged with the latch 30, the latch 31 cannot be engaged with the latch locking portion 8*b*, and thus the opening/closing member 1 is prevented from being locked in a state of one-side tightening (one-side latching). In the present exemplary embodiment, there is adopted such a configuration (FIGS. 11A to 11C) that a first engagement width D at which an engaging surface 30*b* of the latch 30 comes into contact with an engaged surface 8*a*1 of the latch locking portion 8*a* is larger than a second engagement width E at which an engaging surface 31*b* of the latch 31 comes into contact with an engaged surface 8*b*1 of the latch locking portion 8*b*. With this simple configuration, in a case where the opening/closing member 1 is closed by pressing the portion near the latch locking portion 8*b*, the latch locking portion 8*a* does not engage with the latch 30, so that the one-side tightening of the opening/closing member 1 can be prevented.

Figure 14A:
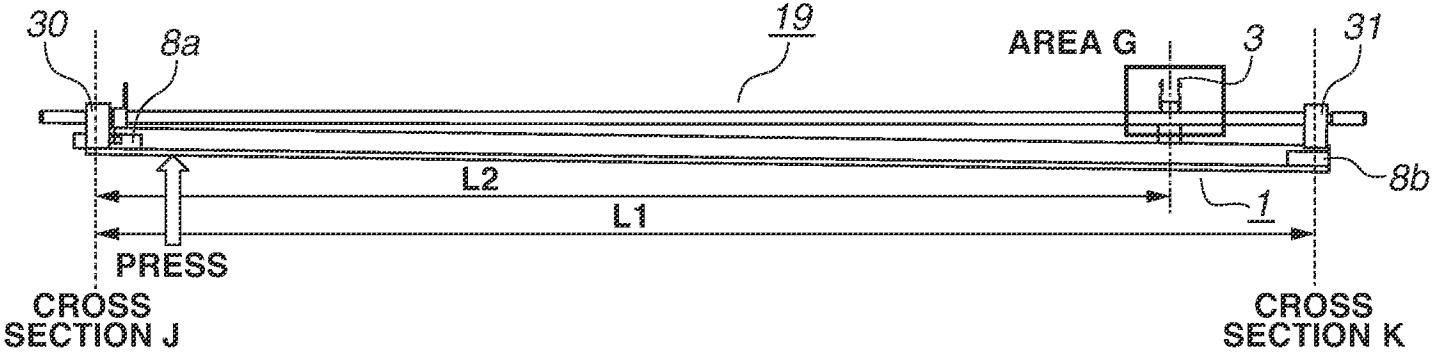
FIGS. 14A, 14B, 14C, and 14D are cross-sectional diagrams illustrating a method of detecting occurrence of one-side tightening of the opening/closing member of the image forming apparatus according to the second exemplary embodiment.
Figure 14B:
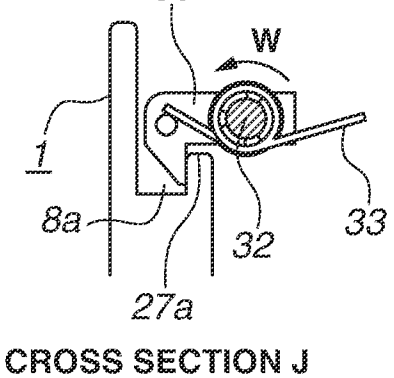
Figure 14C:
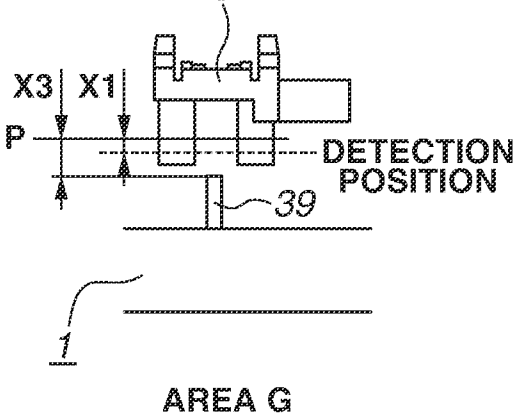
Figure 14D:
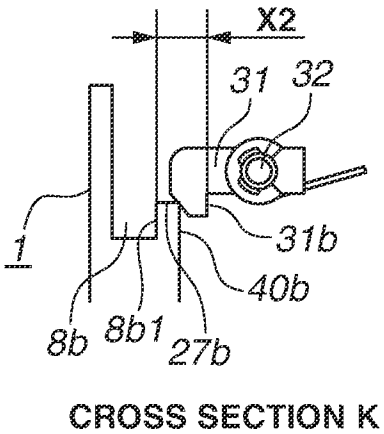

Next, a case where the opening/closing member 1 is closed by pressing a portion near the latch locking portion 8*a* in the opening/closing member 1 to bring the latch 30 into contact with the latch locking portion 8*a* will be described with reference to FIGS. 14A to 14D. FIG. 14A is a top view of a portion near the opening/closing member 1 as viewed vertically from above, illustrating a state where the portion near the latch locking portion 8*a* in the opening/closing member 1 is pressed in closing the opening/closing member 1. FIG. 14B is a cross-sectional diagram illustrating the cross section J in FIG. 14A, FIG. 14C is an enlarged view illustrating the cross section G in FIG. 14A, and FIG. 14D is a cross-sectional diagram illustrating the cross section K in FIG. 14A.

Pressing the portion near the latch locking portion 8*a* brings the opening/closing member 1 into a state where the latch locking portion 8*a* abuts the latch unit 19 prior to the latch locking portion 8*b*, so that the opening/closing member 1 tilts. Pressing the portion near the latch locking portion 8*a* further therefrom causes the latch 30 to advance beyond the top 27*a* as illustrated in FIG. 14B, so that a lock state where a part of the latch 30 is located inside the latch locking portion 8*a* is established. Meanwhile, the latch 31 does not advance beyond the top 27*b* as illustrated in FIG. 14D, and thus there is a case where a lock state where a part of the latch 31 is located inside the latch locking portion 8*b* is not established.

When the state of the one-side tightening thus occurs, the latch locking portion 8*b* of the opening/closing member 1 is pressed by the latch 31 to a position for opening the opening/closing member 1 in an opening direction of the opening/closing member 1, by a predetermined amount X2. At this moment, the protrusion 39 of the opening/closing member 1 dose not sufficiently enter a photo-interrupter disposed in the apparatus main body 100B as the detection member 3, and light traveling from a light emitting unit of an optical sensor to a light receiving unit is not blocked, so that the opening/closing member 1 is detected to be in the open state. Therefore, in the present exemplary embodiment, the detection member 3 detects the open state, so that the image forming apparatus does not execute the image forming operation at the time of the one-side tightening of the opening/closing member 1. Specifically, a distance X3 from a position of the protrusion 39 during the one-side tightening to a position of the protrusion 39 when the opening/closing member 1 is in the closed position is large with respect to a distance X1 from a position of the protrusion 39 for enabling the detection member 3 to detect the closed state to the position of the protrusion 39 when the opening/closing member 1 is in the closed position. Because the distance X3 is large with respect to the distance X1, a condition for an installation position in a product width direction (the axial direction of the pivot axis of the opening/closing member 1) of the detection member 3 is as follows.

$$L2>X1/X2\times L1$$

L2: A distance from the latch 30 to the detection member 3 in the axial direction of the pivot axis of the opening/closing member 1

L1: A distance from the latch 30 to the latch 31 in the axial direction of the pivot axis of the opening/closing member 1

X1: The distance from the position of the protrusion 39 for enabling the detection member 3 to detect the closed state to the position of the protrusion 39 when the opening/closing member 1 is in the closed position X2: The distance between the engaging surface 31*b* of the latch 31 and the engaged surface 8*b*1 of the latch locking portion 8*b* in the pivot direction of the opening/closing member 1

Further, because the distance X3 is large with respect to the distance X1, a condition for an installation position in a product height direction (a direction intersecting the axial direction of the pivot axis of the opening/closing member 1, i.e., a vertical direction) is as follows (FIG. 10).

$$H2>X1/X2\times H1$$

H2: A distance from the pivot axis of the opening/closing member 1 to the protrusion 39 in the direction intersecting the axial direction of the pivot axis of the opening/closing member 1

H1: A distance from the pivot axis of the opening/closing member 1 to the latch 31 in the direction intersecting the axial direction of the pivot axis of the opening/closing member 1

X1: The distance from the position of the protrusion 39 for enabling the detection member 3 to detect the closed state to the position of the protrusion 39 when the opening/closing member 1 is in the closed position X2: The distance between the engaging surface 31*b* of the latch 31 and the engaged surface 8*b*1 of the latch locking portion 8*b* in the pivot direction of the opening/closing member 1

The detection member 3 thus disposed can thereby detect the opening/closing member 1 being in the open state, and stop the operation of the apparatus main body 100B, at the time of the one-side tightening in which the latch 31 is not locked. The one-side latching is thus detected using the detection member 3, so that the configuration can be achieved using a small number of members. Moreover, in the configuration of the present exemplary embodiment, the latch being set in the lock position is not directly detected, so that the placement of the detection member is not restricted by the installation position of each of the latch and the latch locking portion, and thus the image forming apparatus can be downsized.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2019-121946, filed Jun. 28, 2019, which is hereby incorporated by reference herein in its entirety.

What is claimed is:

1. An image forming apparatus comprising:

an apparatus main body configured to form an image;

an opening/closing member configured to pivot on an axis with respect to the apparatus main body between a closed position to close an opening of the apparatus main body and an open position to open the opening;

a lock mechanism configured to hold the opening/closing member in the closed position; and a detection member configured to detect a position of the opening/closing member, wherein the lock mechanism includes a first engaging portion at one end of the apparatus main body in an axial direction of the axis, a second engaging portion at another end of the apparatus main body in the axial direction of the axis, a connection portion connecting the first engaging portion and the second engaging portion, a first engaged portion at one end of the opening/closing member in the axial direction of the axis, and a second engaged portion at another end of the opening/closing member in the axial direction of the axis, wherein, a first engagement width, at which a first engaging surface of the first engaging portion comes into contact with a first engaged surface of the first engaged portion, is larger than a second engagement width at which a second engaging surface of the second engaging portion comes into contact with a second engaged surface of the second engaged portion, in a state where the opening/closing member is in the closed position and locked by the lock mechanism, and wherein the detection member is located closer to the second engaging portion, than the first engaging portion, in the axial direction of the axis.

2. The image forming apparatus according to claim 1, wherein a relationship of L2>X1/X2×L1 is satisfied, where L1 is a distance in the axial direction of the axis from the first engaging portion to the second engaging portion, L2 is a distance in the axial direction of the axis from the first engaging portion to the detection member, X1 is a distance from a position of an acting portion, being a part of the opening/closing member, to be detected by the detection member as the closed position when acting on the detection member to a position of the acting portion in the closed position, and X2 is a distance between the first engaging surface and the first engaged surface in a pivot direction of the opening/closing member.

3. The image forming apparatus according to claim 2, wherein a relationship of H2>X1/X2×H1 is satisfied, where H1 is a distance from the axis to the first engaging portion in a direction intersecting the axial direction of the axis, and H2 is a distance from the axis to the acting portion in the direction intersecting the axial direction of the axis.

4. The image forming apparatus according to claim 1, further comprising an urging unit configured to urge the connection portion to engage the first engaging portion with the first engaged portion and engage the second engaging portion with the second engaged portion.

5. The image forming apparatus according to claim 1, wherein the connection portion moves in the axial direction of the axis to engage the first engaging portion with the first engaged portion and engage the second engaging portion with the second engaged portion.

6. The image forming apparatus according to claim 1, wherein the connection portion pivots on an axis of a connection shaft to engage the first engaging portion with the first engaged portion and engage the second engaging portion with the second engaged portion, the connection shaft having one end connected to the first engaging portion and another end connected to the second engaging portion.

* * * * *